US006368072B1

(12) United States Patent
Inoue et al.

(10) Patent No.: US 6,368,072 B1
(45) Date of Patent: Apr. 9, 2002

(54) HYDRAULIC PUMP

(75) Inventors: Kiyoshi Inoue; Takashi Teraoka; Eizou Urata, all of Tokyo (JP)

(73) Assignee: Kayaba Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/529,669

(22) PCT Filed: Oct. 20, 1998

(86) PCT No.: PCT/JP98/04733

§ 371 Date: Jun. 21, 2000

§ 102(e) Date: Jun. 21, 2000

(87) PCT Pub. No.: WO99/20900

PCT Pub. Date: Apr. 29, 1999

(30) Foreign Application Priority Data

Oct. 20, 1997 (JP) ..... 9-286965

(51) Int. Cl.[7] ..... F04B 1/12; F01B 15/00; F01B 3/00

(52) U.S. Cl. ..... 417/269; 92/66; 92/71

(58) Field of Search ..... 417/269; 92/66, 92/71

(56) References Cited

U.S. PATENT DOCUMENTS 4,606,709 A * 8/1986 Chisolm ..... 417/347
5,086,689 A * 2/1992 Masuda ..... 417/269
5,931,644 A * 8/1999 Glassey et al. ..... 417/269
6,092,457 A * 7/2000 Inoue et al. ..... 92/71

FOREIGN PATENT DOCUMENTS

JP 62-31779 2/1987
JP 2-14475 1/1990
JP 7-189887 7/1995
JP 8-151975 6/1996

* cited by examiner

*Primary Examiner*—Charles G. Freay
*Assistant Examiner*—Michael K. Gray
(74) *Attorney, Agent, or Firm*—Rabin & Berdo, P.C.

(57) ABSTRACT

Sufficient pressure is produced in a pocket of a hydrostatic bearing when a corresponding cylinder is about to switch from a suction stroke to a discharge stroke in order to prevent solid contact of sliding faces. A plurality of cylinders are arranged on a circle around a center axis of a cylinder block rotatably supported in a housing. Pistons reciprocates in the respective cylinders. A suction port and a discharge port provided to the housing selectively communicate with the respective cylinders in accordance with a rotational position of the cylinder block. A drive shaft inclined relative to the center axis of the cylinder block, a rotation transmitting mechanism for transmitting rotation of the drive shaft to the cylinder block for rotating the cylinder block synchronously with the drive shaft, and a rotating disk rotating together with the drive shaft and cooperatively engaged with the pistons are further provided. A fixed sliding contact face is formed in the housing to have a sliding contact with a rear face of the rotating disk. Pressure pockets are formed on the rear face of the rotating disk in correspondence with positions of the respective pistons. Pressure paths for conducting hydraulic pressure in the respective cylinders to the respective pressure pockets via the pistons are further provided. There is further provided a pressure introducing mechanism for introducing a high pressure fluid to a pocket moving along the fixed sliding contact face along with the rotating disk at a position in which a corresponding cylinder is about to switch from a suction stroke to a discharge stroke.

7 Claims, 6 Drawing Sheets

HYDRAULIC PUMP

TECHNICAL FIELD

This invention relates to a hydraulic axial piston pump supporting a rotating disk in a housing via hydrostatic bearings against a reaction force of pistons.

BACKGROUND OF THE INVENTION

In an axial piston pump, a cylinder block has a plurality of pistons, each piston receives a reaction force in accordance with cylinder inner pressure and the reaction force is transferred to a rotating disk rotating along with the cylinder block. A force corresponding to the reaction of the pistons is exerted between a rear face of the rotating disk and the housing, and this force brings about large frictional force on sliding faces of the rotating disk and the housing.

It is known to provide hydrostatic bearings between sliding faces of the rotating disk and the housing in order to reduce the frictional force. The hydrostatic bearing is so constructed that a hole penetrating the piston is connected with a pocket provided at a sliding face of the rotating disk so as to conduct hydraulic pressure in the cylinder to the pocket. The hydraulic pressure in the pocket then acts between the rotating disk and the housing, to reduce contact pressure of the sliding faces and to reduce the frictional force therebetween.

The same number of pockets is provided as that of the pistons, and the inner pressure of each cylinder is conducted to a corresponding pocket. A half of one rotation of the cylinder block corresponds to a suction stroke with which the cylinder inner pressure becomes low and a remaining half of the rotation corresponds to a discharge stroke with which the cylinder inner pressure becomes high. The friction of the sliding faces is changed in accordance with the reaction force of the pistons and is large in the discharge stroke and small in the suction stroke. Therefore, the cylinder inner pressure conducted to the corresponding pocket via the through hole of the piston has a magnitude depending on the reaction force of the piston exerted on the rotating disk. Accordingly, large pressure is exerted in a region having large piston reaction force (discharge stroke) and small pressure is exerted in a region having small piston reaction force (suction stroke) to thereby maintain a balance for the hydrostatic bearing.

However, there is a case in which the high pressure is not exerted immediately to the pocket at a region of switching from the suction stroke to the discharge stroke. Although when the suction stroke is switched to discharge stroke in accordance with rotation of the cylinder block, the cylinder inner pressure is rapidly increased. However, there may be a small delay in transmitting this pressure change to the corresponding pocket. The delay depends on a volume of the pocket or the narrowness of a transmitting path.

In a transient period of time producing such a delay in response, there is a concern in which sufficient support force by the hydrostatic bearing is not produced, solid contact (metal contact) is brought about at the sliding faces and local wear or seizure of the sliding faces may be caused.

It is an object of this invention to resolve such a problem.

Specifically, it is an object of this invention to provide a pocket of a hydrostatic bearing with a sufficiently high pressure for preventing solid contact of the sliding faces in a region where switching from the suction stroke to the discharge stroke is performed.

DISCLOSURE OF THE INVENTION

A hydraulic pump according to this invention comprises a cylinder block rotatably supported in a housing, a plurality of cylinders arranged on a circle a center of which coincides with a center axis of the cylinder block, pistons respectively reciprocating in the cylinders, a suction port and a discharge port provided to the housing selectively communicating with the respective cylinders in accordance with a rotation position of the cylinder block, a drive shaft inclined relatively to the center axis of the cylinder block, a rotation transmitting mechanism for transmitting rotation of the drive shaft to the cylinder block so as to rotate the cylinder block synchronously with the drive shaft, a rotating disk rotating together with the drive shaft and cooperatively engaged with the pistons, a fixed sliding contact face formed in the housing, the fixed sliding contact face being brought into sliding contact with a rear face of the rotating disk, pressure pockets formed on the rear face of the rotating disk in correspondence with positions of the respective pistons, and pressure paths for conducting hydraulic pressure in the respective cylinders to the respective pressure pockets via the pistons.

The hydraulic pump further comprises a pressure introducing mechanism for introducing a high pressure fluid to a pocket moving along the fixed sliding contact face along with the rotating disk at a position in which a corresponding cylinder is about to switch from a suction stroke to a discharge stroke.

According to an aspect of this invention, the pressure introducing mechanism comprises a communication groove formed on a surface of the fixed sliding contact face for connecting the pocket at the position in which the corresponding cylinder is about to switch from the suction stroke to the discharge stroke, and an adjacent pocket corresponding to a cylinder in the discharge stroke.

It is preferable that an orifice is provided midway along the communication groove.

According to another aspect of this invention, the pressure introducing mechanism comprises a fluid path communicating with the discharge port and having an opening in the fixed sliding contact face to communicate with the pocket at the position in which the corresponding cylinder is about to switch from the suction stroke to the discharge stroke.

It is also preferable that the fluid path is provided with an orifice.

According to yet another aspect of this invention, the pressure introducing mechanism comprises a communication groove formed on the fixed sliding contact face and extending in a radial direction for communicating with the pocket at the position in which the corresponding cylinder is about to switch from the suction stroke to the discharge stroke, and a fluid path for introducing high pressure from the discharge port to the communication groove.

It is also preferable that the fluid path is provided with an orifice.

According to this invention, when the drive shaft is rotated, the cylinder block is rotated, the pistons are reciprocated in the respective cylinders, a working fluid is sucked from the suction port to expanding cylinders and the working fluid is discharged from contracting cylinders to the discharge port. Although a force corresponding to inner pressure of the contracting cylinders is exerted on the rotating disk as piston reaction force, the force is supported by a hydrostatic bearing constituted between the rotating disk and the fixed sliding contact face.

It is necessary that support force of respective pockets of the hydrostatic bearing is made to correspond to the force received from the corresponding pistons. Therefore, when the inner pressure of a cylinder is switched from suction pressure to discharge pressure, pressure of the corresponding pocket should be switched without delay.

The working fluid at high pressure is introduced to the pocket immediately before the cylinder is switched from the suction stroke to the discharge stroke by the pressure introducing mechanism. Therefore, the pressure of the pocket responses without being delayed when switching of the cylinder inner pressure takes place, and the hydrostatic bearing achieves always pertinent support force. As a result, excessively large frictional force is not produced between the rotating disk and the fixed sliding contact face, wear or seizure of the sliding faces does not occur, and the durability of the pump is enhanced.

PREFERRED EMBODIMENTS

Figure 1:
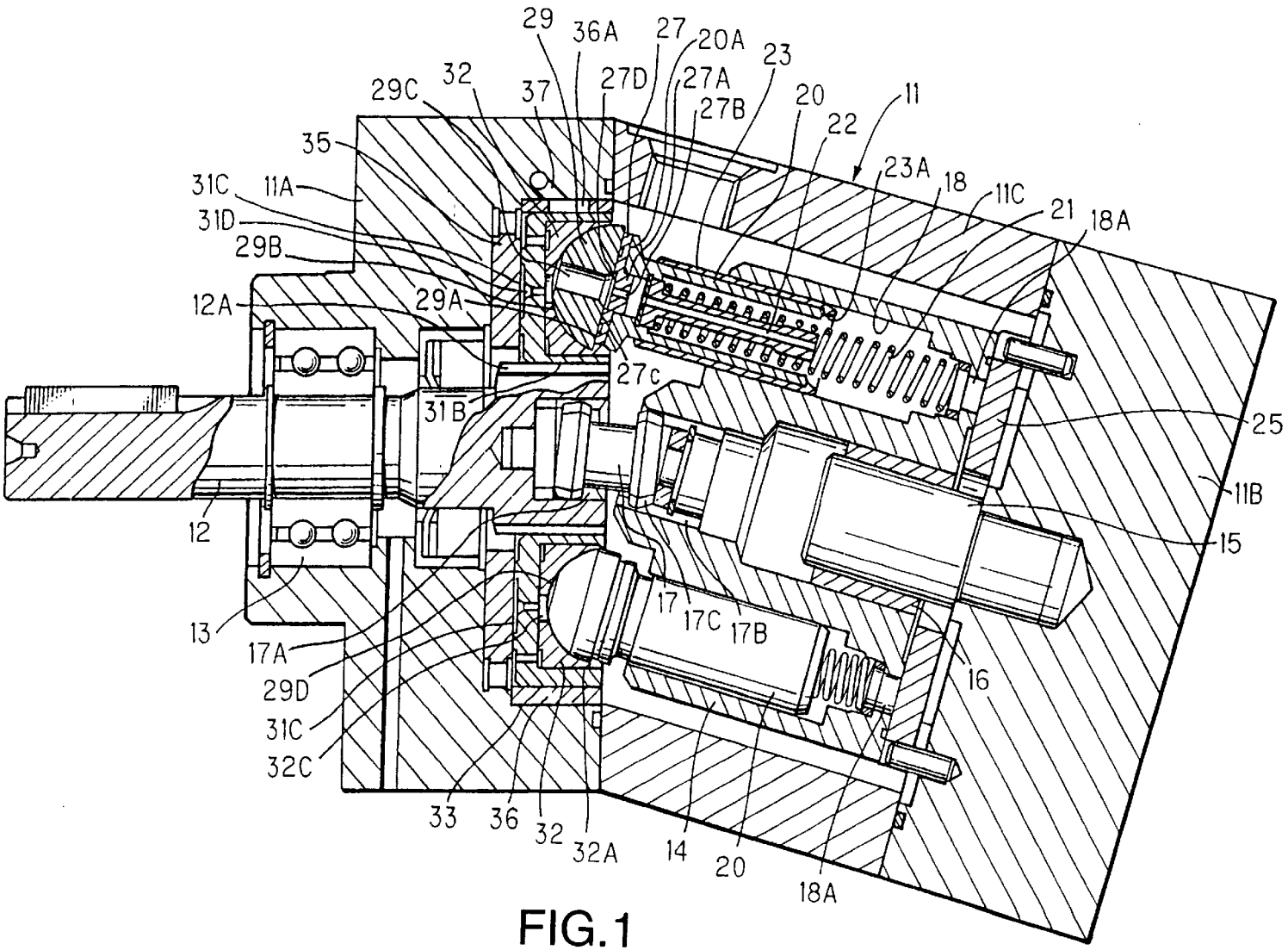
FIG. 1 is a sectional view of a hydraulic pump to which this invention is applied.

In this embodiment, the invention is applied to an axial piston pump, and as shown by FIG. 1, a pump housing 11 comprises a cylindrical case 11C gripped by a side block 11A and a port block 11B.

A pump drive shaft 12 penetrating the side block 11A is rotatably supported by a bearing 13. A cylinder block 14 is arranged at an inner space of the pump housing 11. A rotation shaft 15 supported by the port block 11B is inserted into the center of the cylinder block 14 via a bearing 16 so as to allow the rotation the cylinder block 14 about the rotating shaft 15 as center.

The cylinder block 14 is inclined to the pump drive shaft 12 by a certain angle such that axis centers of the pump drive shaft 12 and the rotating shaft 15 intersect with each other. In order to transmit rotation of the drive shaft 12 to the cylinder block 14, the drive shaft 12 and the cylinder block 14 are connected via a joint 17.

Spline heads 17C are formed at both ends of the joint 17, and inserted into a spline hole 17A formed at an end face of the drive shaft 12 and a spline hole 17B similarly formed at a center of an end face of the cylinder block 14. In these holes, the joint 17 is spline jointed to the drive shaft 12 and cylinder block 14. Outer peripheries of the spline heads 17C are formed in spherical faces so as to always maintain excellent mesh and transmit rotation from the drive shaft 12 to the cylinder block 14 even when the center axes of the spline holes 17A and 17B intersect with each other.

The cylinder block 14 is provided with a plurality of cylinder bores 18 which are disposed at equal intervals on a circle about the rotating shaft 15 as center. Center axes of the cylinder bores 18 are in parallel with the rotating shaft 15. A piston 20 is slidably accommodated in each of the cylinder bores 18.

The piston 20 is urged in an elongating direction by a coil spring 21 arranged in the cylinder bore 18. In order to prevent the spring 21 from being folded to bend, a spring support 22 is arranged inside the coil spring 21. The spring support 22 is disposed in the hollow piston 20 and an end portion thereof is fixed to the piston 20, thereby preventing buckling of the spring 21 and preventing the spring 21 from being brought into contact with an inner periphery of the piston 20. The spring support 22 is formed by a material having small friction.

A piston cover 23 in a tube-like shape formed by synthetic resin (engineering plastic) is fitted on an outer periphery of the piston 20 and is fixed thereto by adhesion. With this construction, friction of a sliding face of the cover 23 with the cylinder bore 18 is maintained small. The piston cover 23 has a length equal to or larger than the effective stroke length of the piston 20, and a flange portion 23A formed at a front end thereof is engaged with an end of the hollow piston 20. The piston cover 23 may be constituted by a high polymer material having small frictional coefficient. A reinforcement material such as carbon fiber may be added to the polymer material.

A valve plate 25 which is brought into contact with a bottom face of the cylinder block 14 is fixed to the port block 11B. The valve plate 25 is provided with a pair of kidney ports (not illustrated), i.e., a suction port and a discharge port to which ports 18A formed in the cylinder block 14 and communicating with the respective cylinder bores 18 successively connect according to rotation of the cylinder block 14. As a result, a working fluid is discharged from the cylinder bores as the pistons 20 contract the cylinder bores, and the working fluid is sucked into the cylinder bores when the pistons 20 expands the same.

A discharge path and a suction path, not illustrated, are formed in the port block 11B and connected to the kidney ports.

Figure 2:
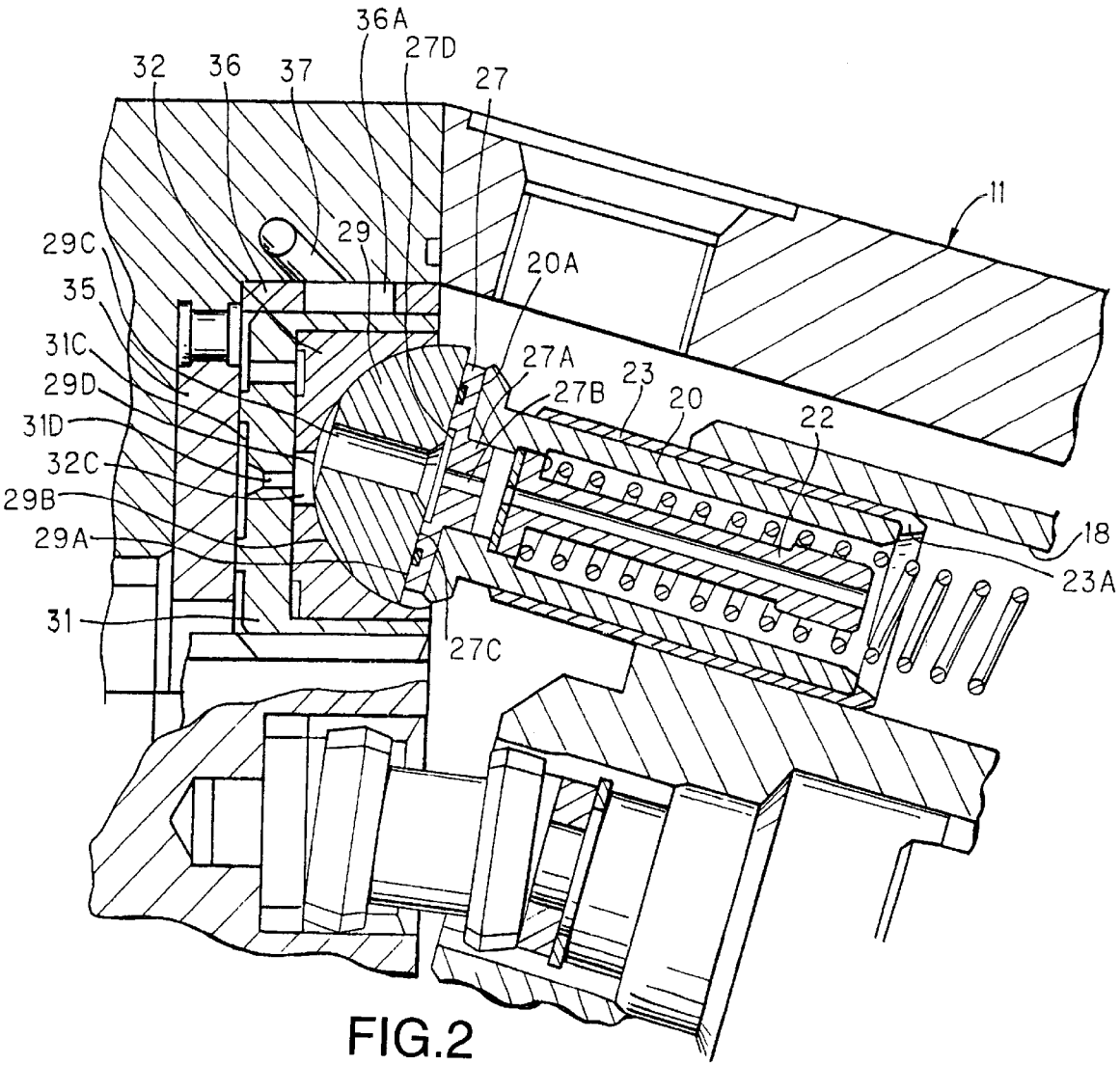
FIG. 2 is an enlarged view of a portion of a piston.

Also as shown by FIG. 2, a plane 20A perpendicular to the center axis of the piston 20 is formed at a front end of the piston 20. The plane 20A is fitted with a pad 27 formed by synthetic resin having small frictional coefficient. The rear face of the pad 27 is provided with a projecting portion 27A which is fitted in a hole of the piston 20. The center of the projected portion 27A is provided with a through hole 27B to thereby communicate with the interior of the piston 20. Further, a flat support face 27C of the pad 27 is formed with a pocket 27D to which the cylinder inner pressure is conducted via the interior of the piston 20.

A shoe 29 in a semispherical shape is brought into contact with the pad 27. The shoe 29 is supported by a socket 32 fitted to a torque plate 31. The torque plate 31 corresponds to a rotating disk arranged around the pump drive shaft 12 on a side of the side block 11A.

The socket 32 is formed by synthetic resin having small frictional coefficient and is fitted to a recess portion 31 A formed in the torque plate 31. The socket 32 is provided with a recess portion 32A in a semispherical shape and a spherical face 29B of the shoe 29 is rotatably accommodated in the recess portion 32A.

A diameter of a flat smooth face 29A of the shoe 29 is formed to be slightly larger or substantially the same as a diameter of the support face 27C of the pad 27 and the flat smooth face 29A and the support face 27C are brought into face contact with each other. As described above, with regard to the contact face, hydraulic pressure in the piston is conducted to the pocket 27D so as to constitute a hydrostatic bearing by fluid between the shoe 29 and the pad 27, support load by the hydraulic pressure, and reduce wear therebetween.

Further, the shoe 29 is formed with a through hole 29C starting from the flat smooth face 29A and ending at the spherical face 29B, the fluid is conducted from the pocket 27D of the pad 27 to a pocket 29D formed at a portion of the spherical face 29B so as to constitute a hydrostatic bearing and reduce wear of the contact faces.

A spline portion 12A formed on the outer periphery of the pump drive shaft 12 is engaged with the torque plate 31 via a spline hole 31B formed at the center of the torque plate 31 so as to rotate the torque plate 31 integrally with the drive shaft 12. Accordingly, the torque plate 31 is rotated in a same direction as that of the cylinder block 14. Therefore, the shoes 29 supported by the sockets 32 of the torque plate 31 and the pistons which are brought into contact with the shoes 29 via the pads 27, are rotated along a circle around the drive shaft 12 as center while always maintaining substantially the same positional relationship among them.

The torque plate 31 is accommodated in a recess portion 33 in a ring shape provided in the side block 11A around the drive shaft 12. A thrust plate 35 in a similar shape is arranged at a bottom face of the torque plate 31 and the thrust plate 35 formed by synthetic resin having small frictional coefficient is fixed to the side block 11A. The torque plate 31 is formed with pockets 31C at a face thereof sliding on the thrust plate 35 and the hydraulic pressure is conducted thereto. The hydraulic pressure is conducted from the hydrostatic bearing formed by the shoe 29 to the pocket 31C via a through hole 32C provided to the socket 32 and a through hole 31D provided to the torque plate 31. Thereby, contact faces of the torque plate 31 and the thrust plate 35 are supported by the hydrostatic bearing and sliding friction is reduced.

Further, a bush 36 made of synthetic resin having small frictional coefficient is arranged on the outer periphery of the torque plate 31 and pressurized fluid is conducted to sliding faces of the outer periphery of the torque plate 31 and the inner periphery of the bush 36 to thereby constitute a hydrostatic bearing and reduce wear therebetween. For that purpose, there is formed a pressure introducing path 37 communicating with a pump discharge path at inside of the side block 11A and the pressurized fluid is conducted to a pocket 36A provided at the sliding faces of the bush 36 and the torque plate 31.

When the pump drive shaft 12 is rotated by a prime mover, not illustrated, the torque plate 31 is rotated together and the cylinder block 14 is also rotated via the joint 17.

Since the cylinder block 14 is inclined relative to the torque plate 31, the distance between the cylinder block 14 and the torque plate 31 facing each other changes as they rotates.

In a rotation position range where the distance between the cylinder block 14 and the torque plate 31 increases after the position at which the distance therebetween has taken the smallest value, the piston 20 expands the cylinder bore while maintaining contact between the piston 20 and the shoe 29 by being pushed by the spring 21, and the working fluid is sucked to the cylinder bore 18 via the port 18A. On the other hand, in another rotation position range where the distance between the cylinder block 14 and the torque plate 31 decreases after the position at which the distance therebetween has taken the largest value, the piston 20 is pushed by the shoe 29 and the fluid in the cylinder bore 18 is discharged from the port 18A. The fluid is sucked from the suction path and discharged to the discharge path by operation of the valve plate 25.

In this way, by rotating the cylinder block 14, the pistons 20 reciprocate while maintaining in contact with the shoes 29 held by the torque plate 31, and suction and discharge of the working fluid from and to the cylinder bore 18 is repeated to thereby function as the axial piston pump.

Meanwhile, a force in the axial direction is exerted on the piston 20 in accordance with pressure of the fluid in the cylinder bore 18 and the force is supported by the torque plate 31 via the shoe 29. In this case, the torque plate 31 is not perpendicular to the center axis of the piston 20 and is inclined thereto by a certain angle. Accordingly, reaction force from the torque plate 31 via the shoe 29 involves a component force in a direction perpendicular to the center axis of the piston 20.

However, the piston 20 and the shoe 29 are always brought into contact with each other by planes perpendicular to the center axis, i.e., the support plate 27C of the pad 27 fitted to the piston 20 is in contact with the flat smooth face 29A of the shoe 29. Accordingly, almost no force in the direction perpendicular to the center axis of the piston 20 which is parallel to these contact faces is transmitted to the piston 20. Therefore, the piston 20 is free from a lateral force acting in the direction perpendicular to the center axis, and a face pressure acting on the inner surface of the cylinder bore 18 is very small.

Rotational torque of the pump drive shaft 12 is transmitted to the cylinder block 14 via the joint 17, as well as to the torque plate 31 via the spline portion 12B. The cylinder block 14 rotates together with the torque plate 31 and accordingly, the pistons 20 and the shoes 29 rotate around the pump drive shaft 12 while maintaining substantially the same positional relationship therebetween. Therefore, no relative torque acts between the pistons 20 and the shoes 29 at any rotation angle and also thereby, large lateral force is not exerted on the pistons 20.

Friction by the sliding faces of the piston 20 and the cylinder bore 18 is produced mainly in accordance with the lateral force exerted on the piston 20, and when the lateral force is reduced in this way, the frictional force can be reduced accordingly. Further, the cover 23 of synthetic resin is fitted to the outer periphery of the piston 20 to thereby reduce sliding resistance at a face thereof in contact with the cylinder bore 18.

As a result, the frictional force of the face of the piston 20 sliding with the cylinder bore 18 is reduced. Therefore, even when water is used as the working fluid, wear of the sliding face is reduced and high durability is achieved.

Further, the pad 27 of synthetic resin having small friction is interposed between the piston 20 and the shoe 29 to thereby avoid metal contact between the piston 20 and the shoe 29. Further, the pocket 27D is formed in the pad 27, inner pressure of the cylinder bore 18 is conducted to the pocket 27D via the interior of the piston 20, and the hydrostatic bearing is constituted between contact faces of the pad 27 and the shoe 29. Therefore, contact pressure therebetween is reduced by the hydraulic pressure, and the wear can be reduced.

The contact pressure between the pad 27 and the shoe 29 becomes high when the piston 20 performs the discharge stroke and conversely, and it becomes low when the piston performs the suction stroke. Therefore, the pressure required for the hydrostatic bearing becomes high in the discharge stroke and low in the suction stroke. Since the inner pressure of the cylinder bore 18 is conducted to the pocket 27D via the piston 20, the characteristics of the pressure provided to the pocket 27D coincides with those required for the hydrostatic bearing. The pocket 27D, therefore, functions as an excellent hydraulic bearing.

Further, the socket 32 of synthetic resin is provided between the shoe 29 and the torque plate 31 to thereby avoid metal contact therebetween by preventing the shoe 29 and the torque plate 31 from being brought into direct contact with each other. Further, the hydraulic pressure is conducted to the spherical contact faces of the socket 32 and the shoe 29 via the pocket 29D to thereby constitute the hydrostatic bearing between the respective contact faces. Therefore, also with regard to these sliding faces, mechanical contact force is reduced and wear is reduced.

The torque plate 31 rotating together with the pump drive shaft 12 suffers reaction forces of the pistons 20 in the discharge stroke, and is pushed towards the recess portion of the side block 11A in the thrust direction and the radial direction in accordance with the inclination of the pistons 20. The torque plate 31 is supported by the thrust plate 35 in the direction of the rotational axis thereof against the thrust force and is supported by the bush 36 in the lateral direction against the radial force. Accordingly, under either of these forces, metal contact of the sliding faces is avoided. Further, between the contact faces of the torque plate 31 and the thrust plate 35 and between the contact faces of the torque plate 31 and the bush 36, hydraulic pressure is conducted and the hydrostatic bearings are constituted respectively. Accordingly, mechanical contact between these members is reduced, wear of the torque plate 31 is reduced, and the durability is enhanced.

In this way, the frictional forces are reduced and wear is reduced with regard to the sliding faces of the piston 20 and the shoe 29, the spherical sliding faces of the shoe 29 and the torque plate 31, and thrust and radial sliding faces of the torque plate 31 and the side block 11A. In this axial piston pump, therefore, high durability can be ensured even when water, which is poor in lubrication performance, is used as the working fluid.

Figure 3:
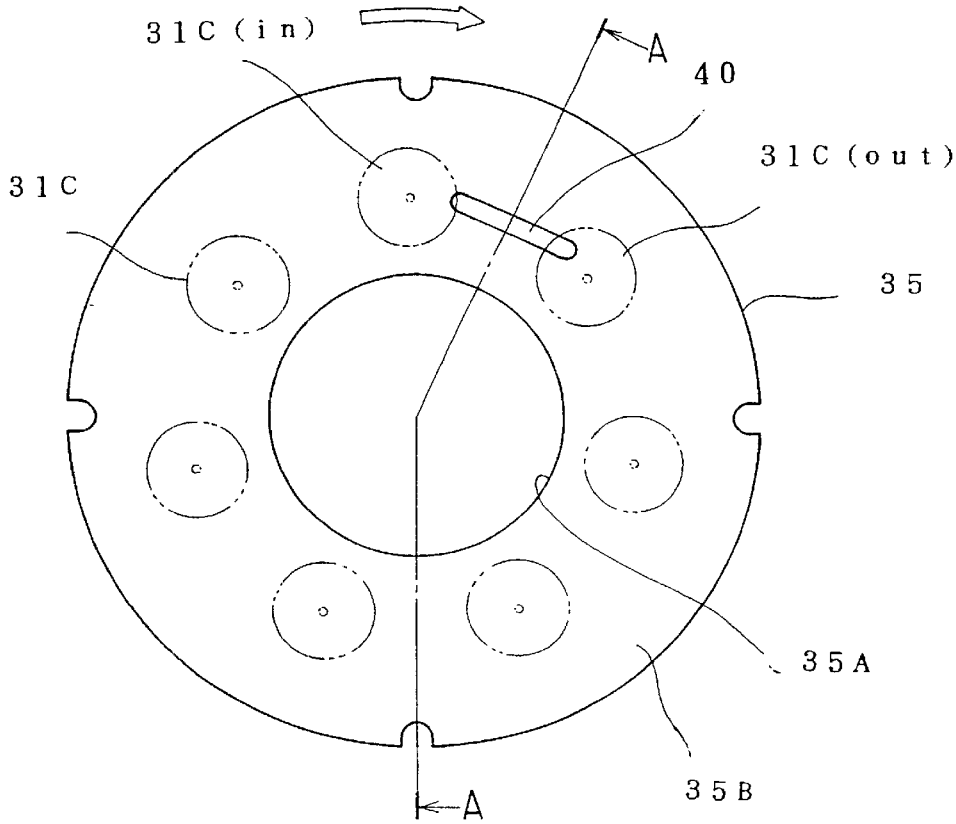
FIG. 3 is a front view of a thrust plate according to a first embodiment of this invention.
Figure 4:
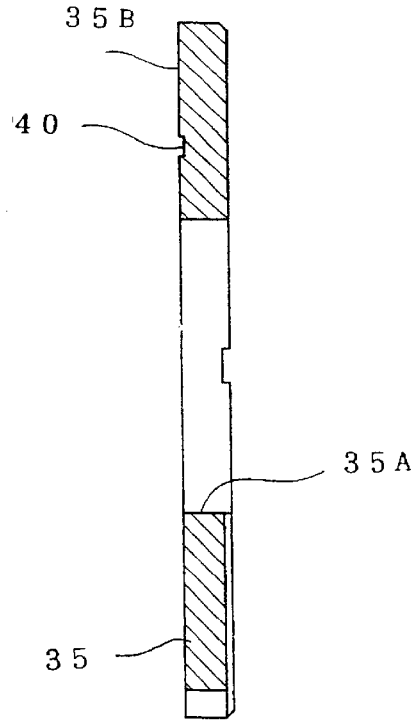
FIG. 4 is a sectional view taken along a line A—A of FIG. 3.

As shown in FIG. 3 and FIG. 4, the thrust plate 35 is provided with a hole 35A for inserting the drive shaft 12 at its center and provided with a flat sliding contact face 35B around the hole 35A. The sliding face 35B is brought into sliding contact with the rear face of the torque plate 31. A plurality of the pockets 31C of the torque plate 31 shown by imaginary lines move in a direction indicated by an arrow mark in accordance with rotation of the drive shaft 12, and positions thereof relative to the sliding contact face 35B of the thrust plate 35 are changed.

The cylinders in correspondence with the pockets 31C communicate with the suction port or the discharge port depending on the rotational positions. In FIG. 3, the respective pockets 31C (in) arranged on the left half side of the thrust plate 35 in the figure corresponds to a suction region wherein the corresponding cylinders communicate with the suction port. On the other hand, the respective pockets 31C (out) arranged on the right half side of the thrust plate 35 in the figure corresponds to a discharge region wherein the corresponding cylinders communicate with the discharge port.

A communication groove 40 extending in the circumferential direction for connecting the two pockets 31C (in) and 31C (out) is formed at a position where the pocket 31C is switched from the suction region to the discharge region on the surface of the sliding face 35B of the thrust plate 35.

With this construction, the pocket 31C (in) is operated with high pressure from the pocket 31C (out) disposed already in the discharge region immediately before the connection of the corresponding cylinder is switched from the suction port to the discharge pressure. Therefore, support force of the thrust hydrostatic bearing constituted by the pocket 31C (in) is increased without delay to the increase in the inner pressure of the corresponding cylinder.

In this way, pressure in the pocket 31C is increased without delay to the change of the inner pressure of the cylinder, and the hydrostatic bearing always achieves pertinent support force. Accordingly, excessively large friction is not produced between the sliding faces of the torque plate 31 and the thrust plate 35, relative rotation therebetween is smooth, so wear or seizure is prevented from causing and the durability of the pump is enhanced.

The shape of the communication groove 40 is not particularly limited. The number of the communication grooves 40 is also not limited to single but can be plural. Although the hydrostatic bearing is formed between the torque plate 31 and the thrust plate 35 in this embodiment, it is also possible to eliminate the thrust plate 35, the torque plate 31 is brought into direct contact with the side block 11A, and the hydrostatic bearing is formed therebetween. In this case, the communication groove 40 is formed directly on a sliding face of the side block 11A.

Figure 5:
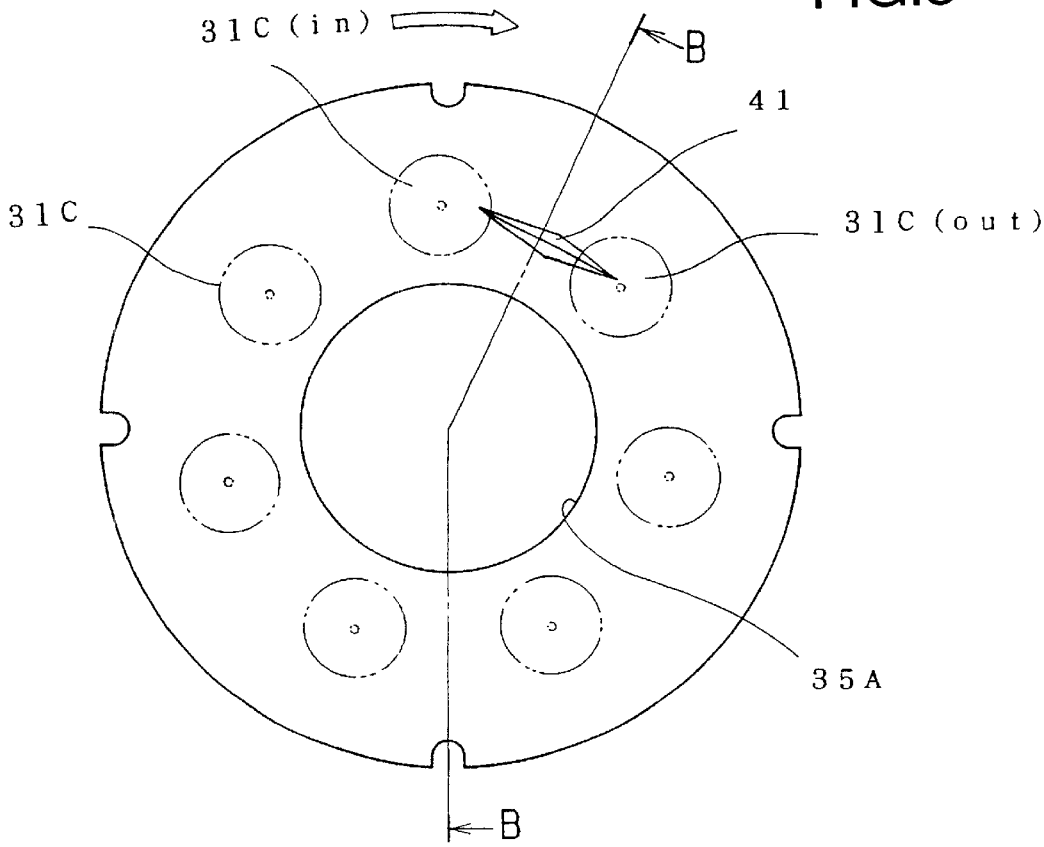
FIG. 5 is a front view of a similar thrust plate according to a second embodiment of this invention.
Figure 6:
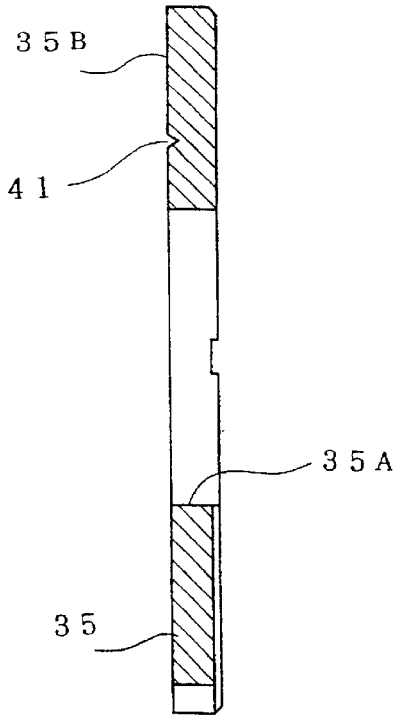
FIG. 6 is a sectional view taken along a line B—B of FIG. 5.

FIG. 5 and FIG. 6 show another embodiment of this invention. According to this embodiment, the thrust plate 35 has a communication groove 41 having a small sectional area functioning as an orifice. The communication groove 41 has a V-shape cross section, and the sectional area thereof gradually changes according to a distance from the pockets. The maximum sectional area is obtained at the middle portion. With this construction, flow of high pressure fluid conducted from the pocket 31C (out) to the pocket 31C (in) is throttled and the flow rate is pertinently restricted. Thereby, leakage of the high pressure fluid is prevented from becoming excessively large, so the pump efficiency is prevented from becoming low.

Figure 7:
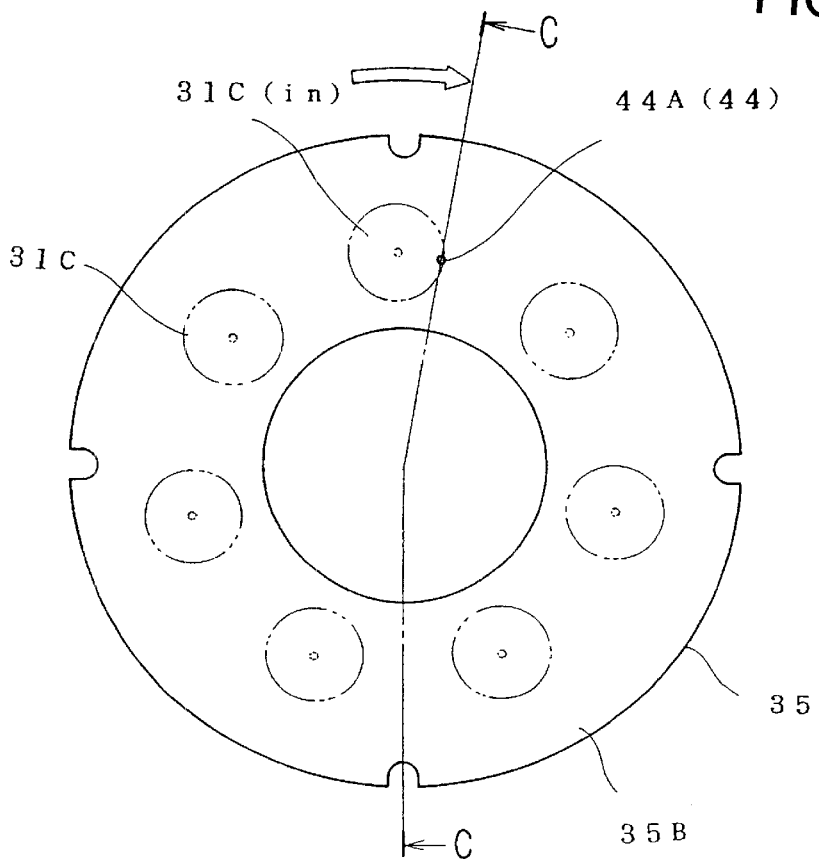
FIG. 7 is a front view of a thrust plate according to a third embodiment of this invention.
Figure 8:
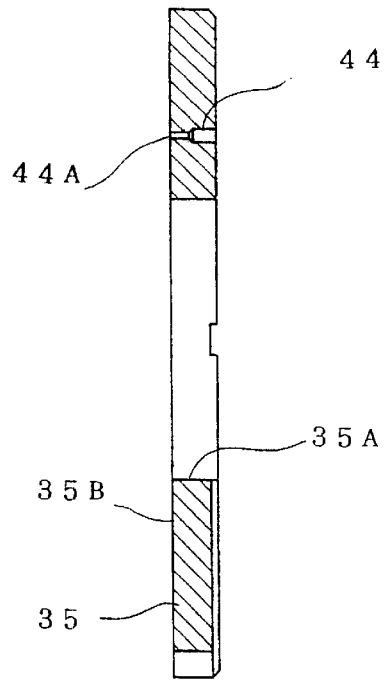
FIG. 8 is a sectional view taken along a line C—C of FIG. 7.

FIG. 7 and FIG. 8 show still another embodiment of this invention.

According to this embodiment, a path 44 penetrating the thrust plate 35 is provided and connected to the discharge port via the pressure introducing path 37 passing through the wall of the pump housing 11.

An opening 44A at the thrust plate sliding contact face 35B of the path 44 is formed at a position slightly deviated from a neutral position towards the discharge region (right half side of FIG. 7) such that the discharge pressure is conducted to the pocket 31C (in) immediately before the pocket 31C (in) is moving from the suction region to the discharge region.

In this case, high pressure can always be conducted to the pocket 31C (in) which is about to move from the suction region to the discharge region via the path 44 and the function of the proper hydrostatic bearing is achieved similar to the aforesaid first and second embodiments. Further, when an orifice or chalk is provided midway along the path 44, the flow rate introduced to the pocket 31C can pertinently be controlled.

Figure 9:
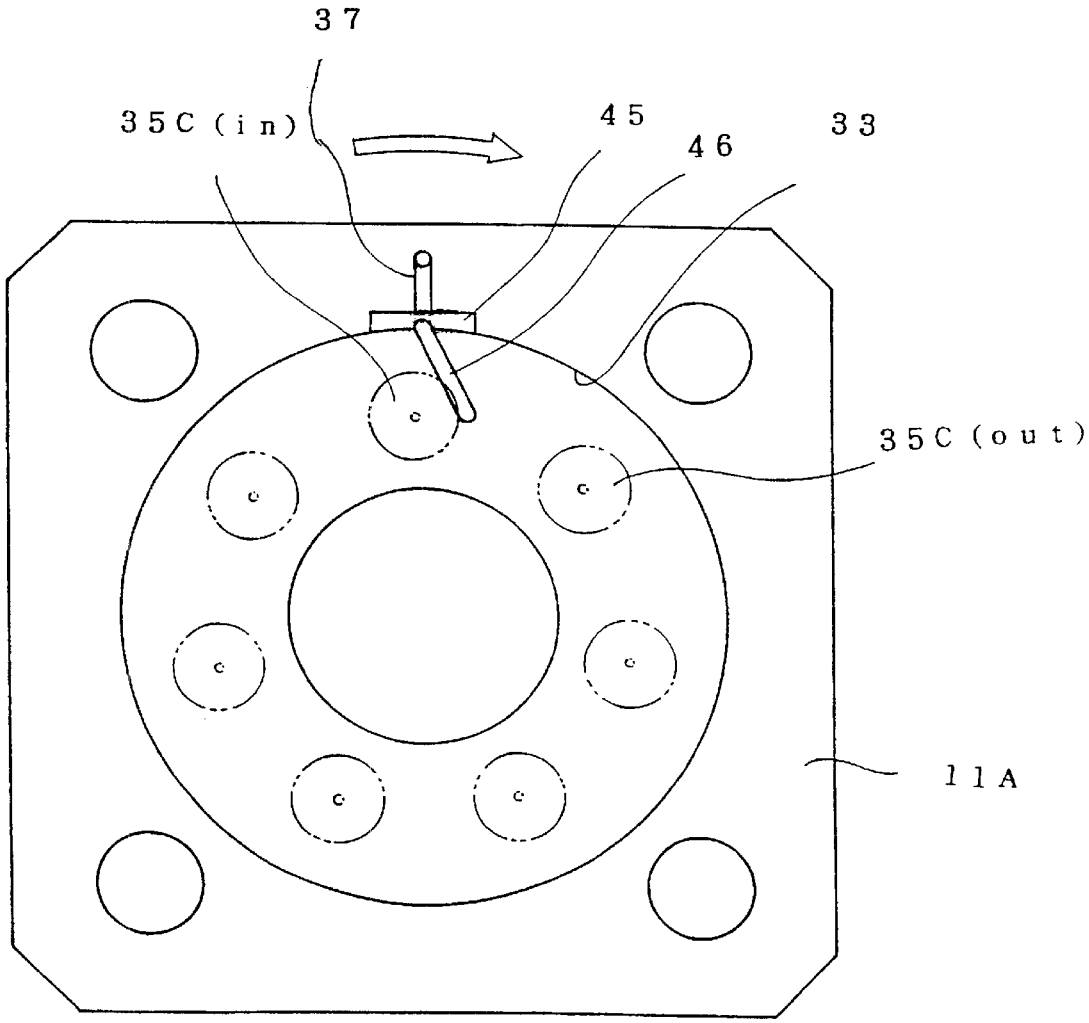
FIG. 9 is a sectional view of a hydraulic pump featuring a thrust plate according to a fourth embodiment of this invention.

Still another embodiment of this invention will be described by referring to FIG. 9.

This embodiment relates to the hydrostatic bearing for conducting pump discharge pressure via the pressure introducing path 37 between the outer peripheral face of the torque plate 31 and the recess portion 33 of the side block 11A. Higher pressure is conducted from the pressure introducing path 37 to a vertical pocket 45 on the inner surface of the recess portion 33. The high pressure is then conducted to communication groove 46 provided on the sliding contact face 35B of the thrust plate 35.

In this case, a communication groove 46 is formed in the radial direction while being inclined slightly from the neutral position of the sliding contact face 35B to the discharge region. Thereby, the communication groove 46 communicates with the pocket 31C (in) when the pocket moves from the suction region to the discharge region so as to introduce the high pressure fluid into the pocket 31*c* (in). In this way, high pressure is introduced with no delay of response when a pocket 31 moves from the suction region to the discharge region and pertinent function of the hydrostatic bearing is maintained.

What is claimed is:

1. A hydraulic pump comprising:

a cylinder block rotatably supported in a housing;

a plurality of cylinders arranged on a circle a center of which coincides with a center axis of the cylinder block;

pistons respectively reciprocating in the cylinders;

a suction port and a discharge port provided to the housing selectively communicating with one end of the respective cylinders in accordance with a rotational position of the cylinder block;

a drive shaft inclined relative to the center axis of the cylinder block;

rotation transmitting means for transmitting rotation of the drive shaft to the cylinder block to thereby rotate the cylinder block synchronously with the drive shaft;

a rotating disk rotating together with the drive shaft and cooperatively engaged with the pistons at another end of the respective cylinders;

a fixed sliding contact face formed in the housing, the fixed sliding contact face being brought into sliding contact with a rear face of the rotating disk;

pressure pockets formed on the rear face of the rotating disk in correspondence with positions of the respective pistons;

pressure paths for conducting hydraulic pressure in the respective cylinders to the respective pressure pockets via the pistons; and pressure introducing means for introducing a high pressure fluid to a pocket moving along the fixed sliding contact face along with the rotating disk at a position in which a corresponding cylinder is about to switch from a suction stroke to a discharge stroke.

2. The hydraulic pump as defined in claim 1, wherein the pressure introducing means comprises a communication groove formed on a surface of the fixed sliding contact face for connecting a pocket at the position in which the corresponding cylinder is about to switch from the suction stroke to the discharge stroke, and an adjacent pocket corresponding to a cylinder in the discharge stroke.

3. The hydraulic pump as defined in claim 2, wherein an orifice is provided midway along the communication groove.

4. The hydraulic pump as defined in claim 1, wherein the pressure introducing means comprises a fluid path communicating with the discharge port and having an opening in the fixed sliding contact face to communicate with a pocket at the position in which the corresponding cylinder is about to switch from the suction stroke to the discharge stroke.

5. The hydraulic pump as defined in claim 4, wherein the fluid path is provided with an orifice.

6. The hydraulic pump as defined in claim 1, wherein the pressure introducing means comprises a communication groove formed on the fixed sliding contact face for communicating with a pocket at the position in which the corresponding cylinder is about to switch from the suction stroke to the discharge stroke and extending in a radial direction, and a fluid path for introducing high pressure from the discharge port to the communication groove.

7. The hydraulic pump as defined in claim 6, wherein the fluid path is provided with an orifice.

* * * * *